United States Patent [19]

Wood

[11] Patent Number: 4,891,959

[45] Date of Patent: Jan. 9, 1990

[54] BI-DIRECTIONAL PIVOT BAND BRAKE FOR AUTOMATIC WASHER

[75] Inventor: Douglas E. Wood, Hagar Township, Berrien County, Mich.

[73] Assignee: Whirlpool Corporation, Benton Harbor, Mich.

[21] Appl. No.: 214,592

[22] Filed: Jul. 1, 1988

[51] Int. Cl.[4] ..... D06F 37/40

[52] U.S. Cl. ..... 68/23.7; 188/77 R; 188/171

[58] Field of Search ..... 68/23.7; 188/26, 77 R, 188/77 W, 171

[56] References Cited

U.S. PATENT DOCUMENTS

| | | | |
|---|---|---|---|
| 698,262 | 4/1902 | Crowdus | 188/77 R |
| 715,231 | 12/1902 | Crowdus | 188/77 R |
| 2,682,934 | 7/1954 | Howarth | 188/77 R |
| 2,933,913 | 4/1960 | Fields | 68/23.7 |
| 3,115,218 | 12/1963 | Waldrop | 68/23.7 X |
| 3,651,899 | 3/1972 | Yoshii | 188/77 R |
| 4,053,032 | 10/1977 | McDonald | 188/77 R |

FOREIGN PATENT DOCUMENTS

| | | | |
|---|---|---|---|
| 14630 | 2/1981 | Japan | 188/77 R |
| 55998 | 11/1986 | Japan | 68/23.7 |
| 2167142 | 5/1986 | United Kingdom | 188/77 R |

*Primary Examiner*—Philip R. Coe

*Attorney, Agent, or Firm*—Hill, Van Santen, Steadman & Simpson

[57] ABSTRACT

A brake mechanism for an automatic washer is provided wherein a brake band is engageable with a hub attached to the wash basket and has both of its ends pivotally mounted on pivot brackets so that braking is effective in either rotational direction of the basket. A spring interconnects the two brackets to continuously bias the band into tight engagement with the hub and a solenoid operated actuator is provided to overcome the force of the spring to loosen the brake. The brackets are mounted on a common pivot post so that one of the band ends will be pulled into radial alignment, by pivoting of the brackets, in either direction of rotation of the basket. This causes the mounting to act as a fixed mount increasing the bidirectional effectiveness of the brake.

14 Claims, 3 Drawing Sheets

BI-DIRECTIONAL PIVOT BAND BRAKE FOR AUTOMATIC WASHER

BACKGROUND OF THE INVENTION

The present invention relates to a brake mechanism for an automatic washer and more particularly to a band brake for retarding motion of the wash basket.

In conventional vertical-axis automatic washers, there is a central agitator which oscillates during the wash portion of the cycle within a wash basket holding the materials to be washed, the wash basket being held in a fixed position relative to the washer cabinet by a brake. For example, U.S. Pat. No. 3,216,227 discloses a direct drive motor that drives an agitator by means of the motor shaft and drives the basket by means of a coupling between the motor housing and the basket. The basket is locked by a brake mechanism comprising a brake shoe controlled by a spring and a solenoid to selectively cause the shoe to engage a drum connected to the rotating wash basket so that the basket will be locked during agitation.

Band brakes are also utilized to provide the braking function in which one of the ends of the band is held in a fixed position and the other end is controlled by a spring and solenoid to selectively tighten or loosen the band to effect braking. A disadvantage of this type of brake arrangement is that the brake is capable of effective braking in only one direction of rotation. The brake drum can slip in the opposite direction even though the brake may be "on".

SUMMARY OF THE INVENTION

The present invention provides a band brake for an automatic washer which achieves effective braking in either direction of rotation of the wash basket. To accomplish this bidirectional braking, each end of the band is connected to a separate pivot bracket or crank. These two brackets are mounted on a common post and then connected via an extension spring that provides the braking tension. When the brake drum rotates in a counter-clockwise direction, for example, the left and right brackets rotate clockwise (due to the friction on the band brake) until the left end of the band is radially aligned with the center of the post. The extension spring then causes the band to provide braking in the clockwise direction.

When the brake drum reverses direction to the counter-clockwise direction, the two brackets pivot counter-clockwise until the right band end is radially aligned with the center of the post. The extension spring then provides the braking force in the counter-clockwise direction.

The pivot band brake may be placed in the "off" position by pulling the two radially inward release ends of the brackets together against the force of the extension spring. This provides the slack needed to allow the brake drum to rotate in the either direction.

DETAILED DESCRIPTION OF THE PREFERRED EMBODIMENTS

Figure 1:
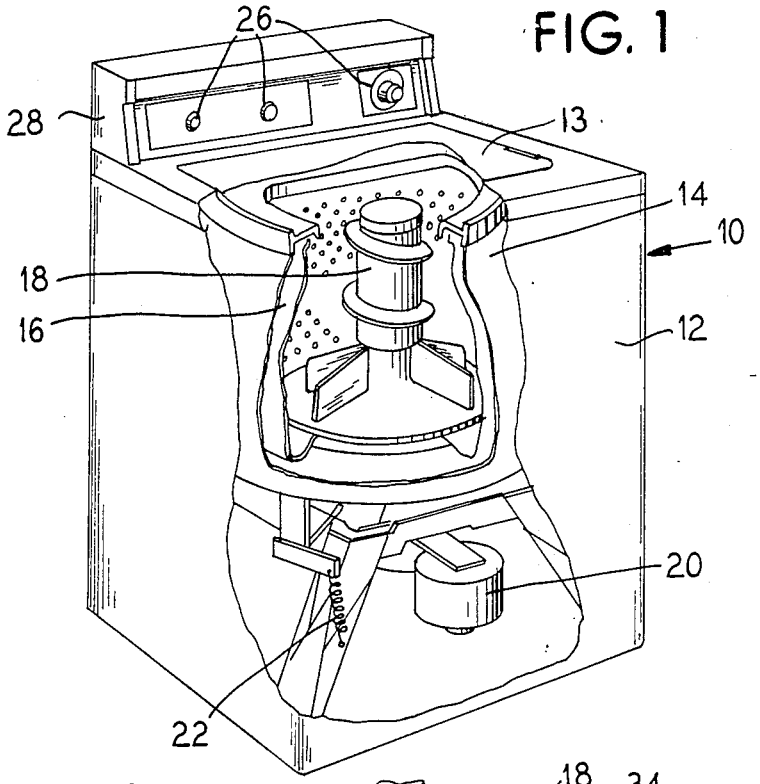
FIG. 1 is a perspective illustration of an automatic washer embodying the principles of the present invention.

In FIG. 1 there is illustrated an automatic washer generally at 10 embodying the principles of the present invention. The washer has an outer cabinet 12 with an openable lid 13 which encloses an imperforate wash tub 14 for receiving a supply of wash liquid. Concentrically mounted within the wash tub is wash basket 16 for receiving a load of materials to be washed in a vertical axis agitator 18. A motor 20 is provided which is drivingly connected to the agitator 18 to drive it in an oscillatory or rotary manner and is also selectively connectable to the basket 16 to rotate or oscillate it. The assembly of tubs, agitator and motor is mounted on a suspension system 22. A plurality of controls 26 are provided on a control console 28 for automatically operating the washer through a series of washing, rinsing and liquid extracting steps.

Figure 2:
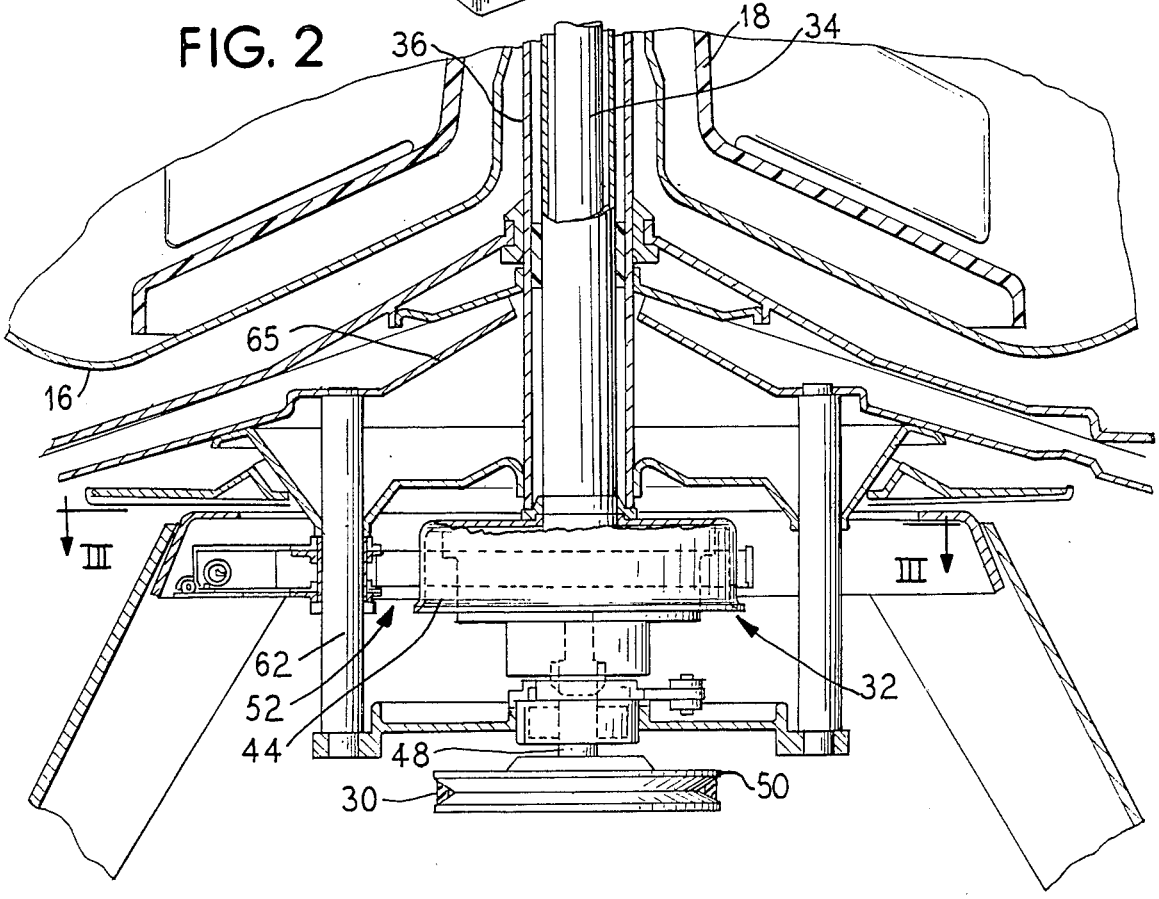
FIG. 2 is a side sectional view of the agitator and drive and brake system of the washer of FIG. 1.

The drive mechanism is shown in greater detail in FIG. 2 where it is seen that the motor 20 is connected by means of a drive belt 30 to a gear arrangement such as a planetary gear assembly 32 to a vertical shaft 34 connected to the agitator 18. In this particular drive arrangement, the motor 20 may be a permanent split capacitor (PSC) motor which is to be reversely operated to provide the oscillatory motion to the agitator and basket. The wash basket 16 is connected via a spin tube 36 to the gear arrangement 32, such as to an outer ring gear having an external generally cylindrical hub surface 44. The vertical shaft 34 is connected to planet gears through the use of a connecting carrier plate and a sun gear is directly connected to a shaft 48 connected to a pulley 50 which is rotated by the belt 30 connected to the motor 20.

When the washer is operating in the agitator mode, the motor 20 is operated in a reversing fashion which causes the shaft 48 to oscillate, thus driving the sun gear in alternating opposite directions. The agitator is therefore oscillated through its connection with the planet gears. The wash basket is held stationary during this operation and to provide the means for holding the basket 16 stationary, a band brake mechanism 52 shown best in FIGS. 3–6 is provided. The mechanism comprises a brake band 54 having a high friction interior lining 56 which is engageable with at least a portion of the circumference of the hub 44 connected to the basket 16. A first end 58 of the band 54 is pivotally connected to a first pivot bracket or crank 60 which is in turn pivotally connected to a fixed vertical post 62 forming a part of a frame 65 of the washer. A second end 64 of the band 54 is pivotally connected to a second pivot bracket or crank 66 which is also pivotally mounted on the post 62. Thus, no additional mounting hardware is required and the brackets can be installed on conventionally configured washing machines. The invention can also be employed in an environment wherein the two brackets 60, 66 are pivotally mounted at separate locations rather than having a common pivot such as post 62.

Figure 4:
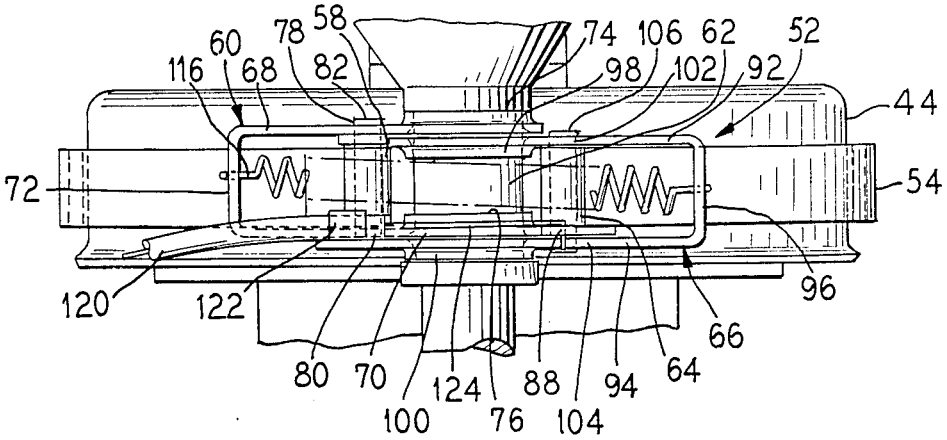
FIG. 4 is a side elevational view taken generally along the line IV—IV of FIG. 3.

As seen best in FIG. 4, the first bracket 60 is formed generally in a U-shape with a top horizontal leg or wall 68, a bottom horizontal leg or wall 70 and a vertical bight leg or wall 72 interconnecting the two horizontal legs. Both the top and bottom legs have an aperture 74, 76, therethrough for being pivotally received on the post 62. The top and bottom legs each have a second aperture 78, 80 therethrough for receiving a vertically oriented pivot pin 82 to which is attached the first end 58 of the brake band 54.

Figure 3:
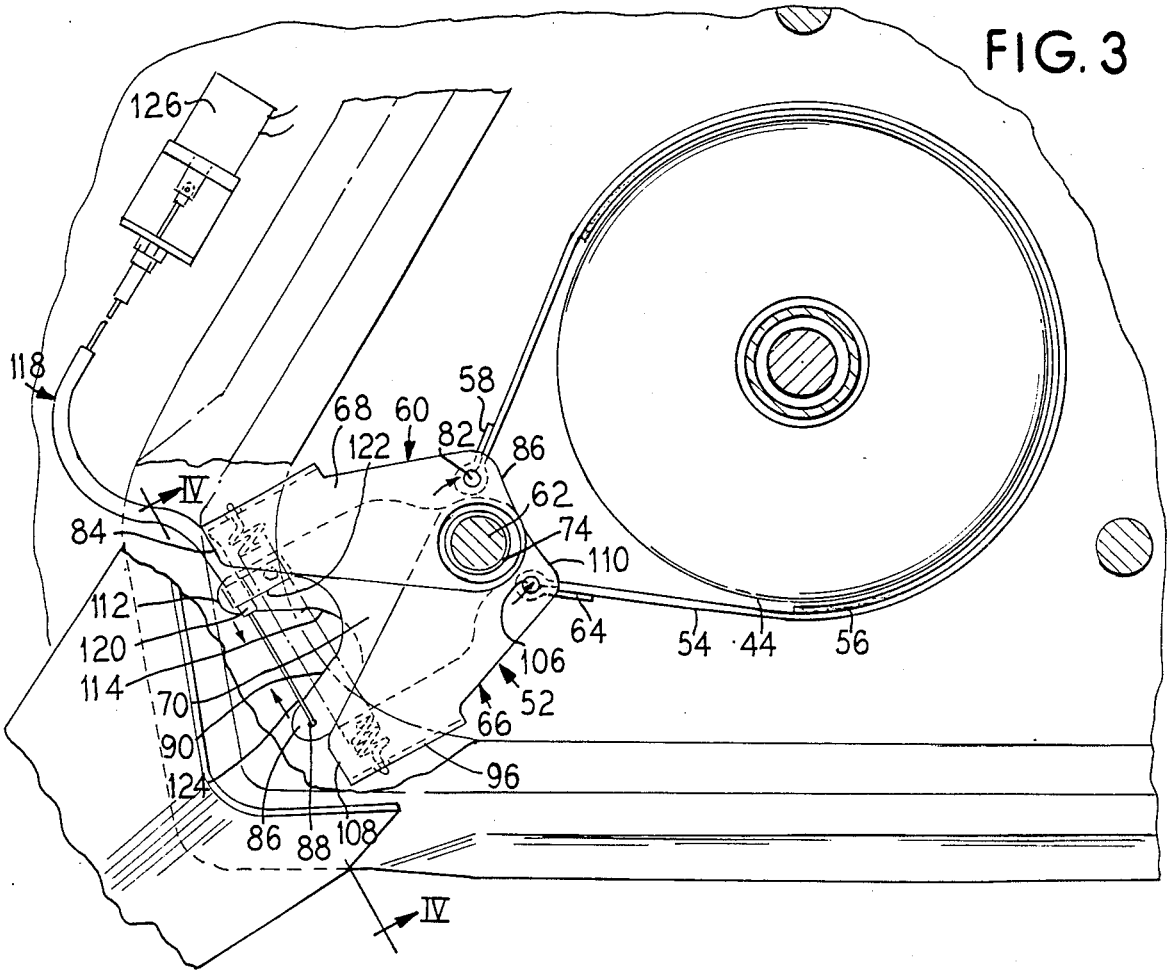
FIG. 3 is a sectional view taken generally along the line III—III of FIG. 2.

As seen in the view of FIG. 3, the first pivot bracket 60 is configured such that the connecting bight leg 72 is positioned at a left side of the bracket adjacent to a left radially outward edge 84. The perimeters of the upper and lower legs are in vertical alignment from the left side of the radial outer edge along the bight leg 72 and radially inwardly to a radially inward edge 86 and along the radially inward edge to a point just to the right of the apertures 74, 76 for the post 62. The perimeter of the top leg 68 then angles radially outwardly and to the left, back toward the left radially outward edge 84. The bottom leg 70, however, proceeds radially outwardly, but extends somewhat to the right and has a right radially outward portion 86 with an aperture 88 therein. The perimeter of the lower leg 70 then proceeds in a concave arcuate manner as illustrated at 90 to the left radially outward edge 84.

The second pivot bracket 66 is configured somewhat similarly, although in a reverse manner. This second bracket 66 also has a top leg or wall 92 and a bottom leg or wall 94 with a connecting bight leg or wall 96. The top and bottom legs have apertures 98, 100 therethrough for receiving the post 62 and they have apertures 102, 104 for receiving a vertically oriented pivot pin 106 to which the second end 64 of the brake band 54 is attached. The height of the bight leg 72 of the first bracket 60 and the bight leg 96 of the second bracket 66 is the same so that the spacings of the two top and bottom legs is identical. The two brackets are arranged so as to be overlapping such that the top leg 68 of the first bracket 60 overlies the top leg 92 of the second bracket 66 and the bottom leg 70 of the first bracket 60 overlies the bottom leg 94 of the second bracket 66.

The bight leg 96 of the second bracket is positioned, from the vantage point of FIG. 3, at the right radially outward edge 108. Again, the top and bottom walls have perimeters in alignment along the bight leg 96 and radially inwardly to a radially inward end 110 and along the radial inward end to a point just to the left of the apertures 98, 100. The top leg angles radially outwardly and rightwardly back toward the radial outward end 108 from a point just to the left of the post aperture 98, but the bottom wall 94 extends radially outwardly and somewhat to the left to end in a left radially outward edge 112. The perimeter of the bottom wall then extends in a concave arcuate manner indicated at 114 back toward the right radially outward edge 108.

The centers of the apertures 78, 80 and 102, 104 for the pivot pins 82, 106 are positioned radially inwardly of the centers of the apertures for the post 62. A spring 116 is attached at either end to the bight legs 72, 96 and operates to continuously bias those two walls towards each other. Thus, a line connecting the spring attachment point, the post 62 centerpoint and the pivot pin centerpoint has an L-shape so that the bracket functions as a bell crank.

An actuator mechanism is provided to overcome the bias of the spring to turn the brake "off". A Bowden cable 118 has its outer sheath 120 secured to the left radially outward edge portion 112 of the lower leg 94 of the second bracket 66 by a clamp 122 and its cable portion 124 is captured in the aperture 88 near the right radially outward edge 86 of the lower wall 70 of the first bracket 60. A solenoid 126 is operatively connected to the cable 124 to selectively withdraw or extend it from the sheath 120. If the cable 124 is drawn into the sheath, the first bracket 60 will be pivoted clockwise on the post 62 relative to the second bracket 66. This will result in the two sets of apertures 78, 80 and 102, 104 being moved towards each other thereby loosening the brake band 54 on the hub 44 to reduce or eliminate any braking effect of the band on the hub. Thus, the bias of the spring 116 is overcome.

When the cable is extended from the sheath then the spring 116 will cause the two bight legs to move towards each other and therefore the two sets of apertures 78, 80 and 102, 104 move away from each other, thus tightening the band 54 on the hub.

Figure 5:
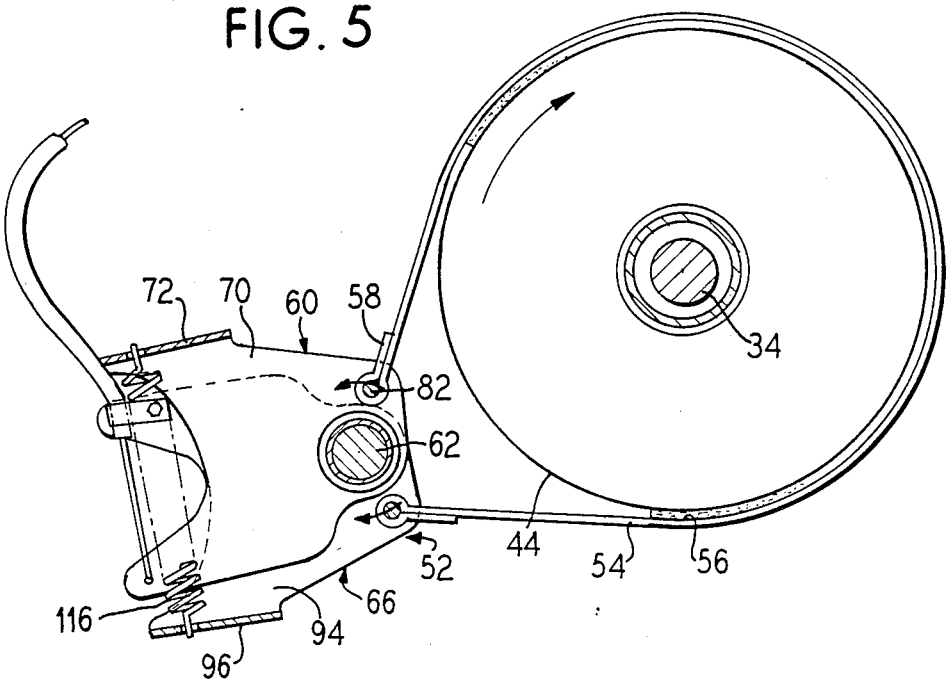
FIG. 5 is a sectional view similar to FIG. 3 illustrating the position of the pivot brackets and band brake when the basket is rotating in a clockwise direction.
Figure 6:
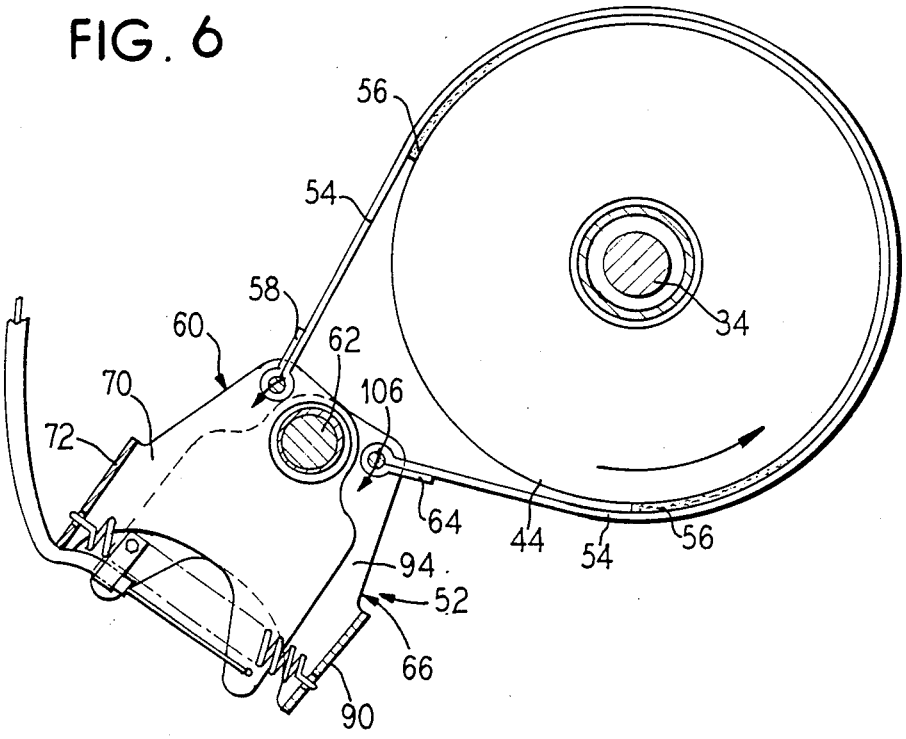
FIG. 6 is a sectional view similar to FIG. 3 illustrating the position of the pivot brackets and band brake when the basket is rotating in a counter-clockwise direction.

The mounting arrangement of the two ends 58, 64 of the band 54 and the two brackets 60, 66 permits the brake to be effective in either rotational direction of the hub 44. As illustrated in FIG. 5, when the hub rotates in a clockwise direction, the first and second brackets are caused to rotate about the post 62 in a clockwise direction (due to the friction on the brake band 54). This rotation of the bracket will continue until the first end 58 of the band is in radial alignment with the center of the post 62 causing the pin 82 to act as a fixed mounting post assuring effective braking in that direction. When the hub begins to rotate in a counter-clockwise direction, the two brackets will also rotate about the hub 62 in a counter-clockwise direction until the second end 64 of the band 54 is in radial alignment with the center of the post 62, shown in FIG. 6. At that point, the pivot pin 106 will act as a fixed attachment point assuring effective braking of the hub in a counter-clockwise direction.

Thus, the present arrangement provides for effective braking in either direction of rotation of the wash basket and hub with a relatively simple assembly and limited number of parts which are adapted to be incorporated into conventionally configured washing machines.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. An automatic washer having a vertical axis agitator, a concentrically mounted wash basket, a motor drivingly connected to said agitator and wash basket to selectively oscillate and rotate said agitator and basket about said vertical axis, and a brake mechanism to selectively prevent rotary movement of said tub, comprising:

a brake band frictionally engageable with a portion of said basket, said band having a first end and second end, means for mounting said first and second ends to each be pivotally movable about a fixed common pivotable axis, and means for moving said first and second ends about said pivotable axis relative to each other so as to tighten or loosen the engagement of said belt with said basket, wherein said brake band will be equally effective in either direction of rotation of said basket.

2. An automatic washer according to claim 1, wherein said means for mounting said first and second ends comprises a first bracket pivotally mounted on a frame of said washer to which said first end is pivotally mounted and a second bracket pivotally mounted on said frame to which said second end is pivotally mounted.

3. An automatic washer according to claim 2, wherein said first and second brackets are mounted to a common pivot post comprising said fixed common pivotable axis.

4. An automatic washer according to claim 2, wherein said means for moving said first and second ends comprises means for pivoting said two brackets relative to one another.

5. An automatic washer according to claim 4, wherein said means for pivoting said two brackets comprises a common spring attached to said brackets to bias said brackets together and a solenoid to urge said brackets apart.

6. A brake mechanism for an automatic washer having vertical axis agitator, a wash basket, a motor drivingly connected to said agitator and basket to selectively rotate and oscillate said agitator and basket about said vertical axis, said brake mechanism comprising:

a brake band having a first and second end and a central portion frictionally engageable with said basket, a first crank member pivotally mounted to a frame of the washer about a fixed pivot axis, said first end of said band being pivotally attached to said first crank member, a second crank member pivotally mounted to the frame of the washer about said fixed pivot axis, said second and of said band being pivotally attached to said second crank member, and means for moving said first and second ends of said band relative to each other to loosen or tighten the engagement of said band with said basket, wherein, said brake mechanism will be equally effective in either direction of rotation of said basket.

7. A brake mechanism according to claim 6, wherein the attachment of said first and second band ends to said first and second crank members is arranged such that as said crank members are pivoted toward each other, the band ends move apart.

8. A brake mechanism according to claim 7, wherein the band is arranged so as to be tightened on said basket as said band ends move apart.

9. A brake mechanism according to claim 7, wherein a spring connects said first and second cranks and continuously urges the two cranks to pivot towards each other.

10. A brake mechanism according to claim 9, wherein an actuator mechanism is provided with a fixed portion attached to one of said cranks and a movable portion attached to the other of said cranks so that said cranks can be moved to pivot away from each other against the action of said spring.

11. A brake mechanism for an automatic washer having a vertical axis agitator, a wash basket, a motor drivingly connected to said agitator and basket to selectively rotate and oscillate said agitator and basket about said vertical axis, said brake mechanism comprising:

a brake band having a first and second end and a central portion frictionally engageable with said basket, a first bracket pivotally mounted intermediate of its ends on a pivot post carried on a frame of said washer, said first end being pivotally mounted on a first side of said bracket relative to said post, a second bracket pivotally mounted intermediate of its ends on said pivot post, said second end being pivotally mounted on a first side of said second bracket relative to said post, means for moving said first and second ends of said band relative to each other to loosen or tighten the engagement of said band with said basket comprising a common spring attached to a second side of said brackets relative to said post to bias said second side of said brackets together and a movable actuator means operably connected to said second side of said brackets to move said second side of said brackets apart, wherein as said second sides of said brackets are pivoted toward each other about said common pivot post in a scissors-like manner, the band ends move apart from each other, and as said second sides of said brackets are pivoted away from each other about said pivot post, the band ends move toward each other such that said brake mechanism will be equally effective in either direction of rotation of said basket.

12. A band brake mechanism according to claim 11, wherein said common spring comprises a coil spring.

13. A band brake mechanism according to claim 11, wherein said movable actuator means comprises a solenoid connected to the brackets by a Bowden cable.

14. A band brake mechanism according to claim 11, wherein said brackets are formed generally in a U-shape with a top horizontal leg, a bottom horizontal leg and a vertical bight leg interconnecting the two horizontal legs, both the top and bottom legs having an aperture therethrough for being pivotally received on the post and the top and bottom legs each having a second aperture therethrough for receiving a vertically oriented pivot pin to which is attached the first and second end of the brake band.

* * * * *